US009492856B2

(12) United States Patent
Hanazaki et al.

(10) Patent No.: US 9,492,856 B2
(45) Date of Patent: Nov. 15, 2016

(54) ELEMENT WIRE, ELECTRIC WIRE AND PROCESS FOR PRODUCING ELEMENT WIRE

(75) Inventors: Kenichi Hanazaki, Shizuoka (JP); Satoru Yoshinaga, Susono (JP); Nobuhiro Tsuji, Osaka (JP)

(73) Assignee: Yazaki Corporation, Tokyo (JP)

( * ) Notice: Subject to any disclaimer, the term of this patent is extended or adjusted under 35 U.S.C. 154(b) by 435 days.

(21) Appl. No.: 12/073,157

(22) Filed: Feb. 29, 2008

(65) Prior Publication Data

US 2008/0213589 A1 Sep. 4, 2008

(30) Foreign Application Priority Data

Mar. 2, 2007 (JP) ..... 2007-053396

(51) Int. Cl.
*B32B 15/02* (2006.01)
*B05B 5/12* (2006.01)
(Continued)

(52) U.S. Cl.
CPC ..... *B21C 23/26* (2013.01); *B21C 1/00* (2013.01); *B21C 37/042* (2013.01); *Y10T 428/2964* (2015.01)

(58) Field of Classification Search
CPC ..... B21C 23/26; B21C 37/042; B21C 1/00; B21C 37/04; B21C 23/24; B21C 23/30; B05B 5/12; B32B 15/02; B21F 27/08; B21F 27/00; B21D 11/02; B21D 11/00; B22D 11/06; B22D 11/01; B21J 7/14; B21J 7/00; Y02E 60/126; H01M 4/73; H01M 4/74;
(Continued)

(56) References Cited

U.S. PATENT DOCUMENTS 1,977,932 A * 10/1934 Wright ..... 106/227
2,287,589 A * 6/1942 Wilson et al. ..... 118/125
(Continued)

FOREIGN PATENT DOCUMENTS

DE 2410898 A1 9/1975
DE 19538190 A1 4/1997
(Continued)

OTHER PUBLICATIONS

The translation of the Office Action issued on the corresponding German patent application 10 2008 011 884.2-14.
(Continued)

*Primary Examiner* — Hai Vo
(74) *Attorney, Agent, or Firm* — Locke Lord LLP

(57) ABSTRACT

An element wire, an electric wire including the element wire or the element wires, and a process for producing an element wire are provided, by which ductility of a core wire consisting of the element wires can be improved. The element wire is made of metal, at least one element wire being coated with an electrically insulating coating so as to constitute an electric wire. The crystal grains constituting the entire element wire are fine isometric grains. In the process for producing the element wire, an electrically conductive material is subjected to drawing so as to reduce a diameter of the material and subsequently subjected to successive bending along a longitudinal direction of the material.

4 Claims, 4 Drawing Sheets

(51) Int. Cl.
*B21C 23/26* (2006.01)
*B21C 1/00* (2006.01)
*B21C 37/04* (2006.01)

(58) Field of Classification Search
CPC ..... H01M 10/18; H01M 10/342; H01M 4/82; H01M 10/06; H01L 21/60; H01B 1/026; H01B 1/02; E21B 17/00; E21B 17/023; E21B 19/12; E21B 17/02; E21B 19/00; F16G 11/02; F16G 11/00; F04B 53/145; F04B 53/00; C21D 9/52; C22F 1/14; C22F 1/08; C22C 9/00; C22C 9/02; C25D 1/04; C25D 3/38; C25D 7/0614; C25D 1/12; C25D 1/00; Y10T 29/4979; Y10T 29/301; Y10T 29/307; Y10T 29/49789; Y10T 428/12431; Y10S 428/935
USPC ..... 428/392, 688, 373, 930, 689, 701, 702, 428/606, 935; 505/230, 231, 239, 701, 702, 505/703, 815, 919, 920, 921; 72/284, 285, 72/39, 107.4, 56, 43, 467, 278, 289, 57, 72/419, 296; 264/444; 148/320, 598, 595, 148/660, 330, 599; 439/164, 15
See application file for complete search history.

(56) References Cited

U.S. PATENT DOCUMENTS

| | | | | | |
|---|---|---|---|---|---|
| 2,536,738 | A | * | 1/1951 | Green | 72/166 |
| 2,568,303 | A | * | 9/1951 | Rosenthal | 72/282 |
| 3,060,587 | A | * | 10/1962 | Picken | 33/529 |
| 3,339,396 | A | * | 9/1967 | Carlson | 72/289 |
| 3,901,064 | A | * | 8/1975 | Jacobson | 72/388 |
| 5,170,015 | A | * | 12/1992 | Kudo et al. | 174/128.1 |
| 5,830,583 | A | * | 11/1998 | Clouser et al. | 428/606 |
| 5,935,911 | A | * | 8/1999 | Yamada et al. | 505/230 |
| 6,896,749 | B2 | * | 5/2005 | Morere et al. | 148/437 |
| 2007/0234542 | A1 | | 10/2007 | Eickemeyer et al. | |

FOREIGN PATENT DOCUMENTS

| | | | |
|---|---|---|---|
| DE | 10339867 | A1 | 4/2005 |
| JP | 09-010898 | A | 1/1997 |
| JP | 2001-226745 | A | 8/2001 |

OTHER PUBLICATIONS

Office Action mailed Oct. 2, 2012, issued for the corresponding Japanese Patent Application No. 2007-053396 and English translation thereof.

* cited by examiner

ELEMENT WIRE, ELECTRIC WIRE AND PROCESS FOR PRODUCING ELEMENT WIRE

BACKGROUND OF THE INVENTION (1) Field of the Invention

The present invention relates to an element wire made of metal, at least one said element wire being coated with an electrically insulating coating so as to constitute an electric wire, an electric wire including the element wire or the element wires, and a process for producing an element wire.

(2) Description of the Related Art

Generally, a motor vehicle as a mobile unit mounts various electronic equipment, for example, a lamp such as a headlamp or tail lamp, a motor such as a starter motor or motor for an air conditioner, and so on.

In order to supply electric power to the various electronic equipment described above, the motor vehicle is provided with a wiring harness. The wiring harness includes a plurality of electric wires. The electric wire includes an electrically conductive core wire and an electrically insulating coating which coats the core wire. The core wire includes a plurality of element wires. The element wire is made of electrically conductive metal such as copper. The element wire is formed long having a round shape in section.

The element wire described above can be obtained by subjecting an electrically conductive material to rolling or drawing. Therefore, even if a crystal grain of the element wire is an isometric grain before drawing of the element wire, the crystal grain of the element wire becomes an elongated grain after the drawing. Generally, a core wire consisting of element wires, a crystal grain of which is an elongated grain, tends to deteriorates in terms of its ductility, that is, tends to be easily broken under tension. Therefore, when the element wire, a crystal grain of which is an elongated grain, becomes thin as the electric wire constituting the wiring harness becomes thin, the element wire constituting the core wire of the electric wire tends to be easily broken upon mounting of the wiring harness on a motor vehicle and therefore, handling of the wiring harness requires particular caution to a worker.

It is possible to make a crystal grain of the element wire be an isometric grain by subjecting the element wire, a crystal grain of which is an elongated grain, to a heat treatment. However, in this case, the crystal grain grows excessively, causing a problem that mechanical strength of the core wire is deteriorated although the ductility of the core wire is improved. Alternatively, it is possible to make a crystal grain of the element wire be a fine isometric grain by subjecting the element wire, a crystal grain of which is an elongated grain, to deposition so as to generate a second phase. However, in this case, addition of an another element and a deposition processing by heating are required, causing a cost-up for producing the electric wire due to an increase in required man-hour.

SUMMARY OF THE INVENTION

It is therefore an objective of the present invention to solve the above problem and to provide an element wire, an electric wire including the element wire or the element wires, and a process for producing an element wire, by which the ductility of the core wire can be improved.

In order to attain the above objective, the present invention is to provide an element wire made of metal, at least one said element wire being coated with an electrically insulating coating so as to constitute an electric wire, characterized in that crystal grains constituting the entire element wire are fine isometric grains.

With the construction described above, since the crystal grains constituting the whole of the element wire are fine isometric grains, therefore the ductility of the core wire is improved. As a result, the element wire is hardly broken when the wiring harness is being mounted on a motor vehicle. That is, handling of the wiring harness does not require particular caution to a worker. Furthermore, since such an element wire is excellent in terms of ductility and mechanical strength, therefore the element wire is hardly broken when the electric wire is being produced and when the wiring harness is being assembled as well as when the wiring harness is being mounted on a motor vehicle.

An electrically conductive material is subjected to drawing so as to reduce a diameter of the conductive material and subsequently subjected to successive bending along a longitudinal direction of the conductive material, so that the element wire is obtained.

With the construction described above, the elongated grain of the electrically conductive material is divided into parts thereof and therefore, the crystal grains constituting the entire element wire become fine isometric grains. Accordingly, the ductility of the element wire can be securely improved.

The drawing is performed plural times successively.

With the construction described above, the element wire can be made thin.

The electrically conductive material subjected to the drawing is allowed to pass through a bent through hole while being moved in the longitudinal direction of the material, so that the material is subjected to the successive bending along the longitudinal direction of the material.

With the construction described above, the crystal grains constituting the whole of the element wire securely become fine isometric grains. Accordingly, the ductility of the element wire can be securely improved.

In order to attain the above objective, the present invention also is to provide an electric wire including; a core wire having at least one element wire described above; and a coating which coats the core wire.

With the construction described above, since the electric wire includes the element wire described above, therefore the ductility of the electric wire can be improved. Accordingly, the element wire is hardly broken when the wiring harness is being mounted on a motor vehicle. That is, handling of the wiring harness does not require particular caution to a worker.

In order to attain the above objective, the present invention also is to provide a process for producing an element wire made of metal, at least one said element wire being coated with an electrically insulating coating so as to constitute an electric wire, characterized in that an electrically conductive material is subjected to drawing so as to reduce a diameter of the material and subsequently subjected to successive bending along a longitudinal direction of the material, thereby obtaining the element wire.

With the construction described above, the crystal grains constituting the entire element wire become fine isometric grains. Accordingly, the ductility of the element wire can be securely improved.

DESCRIPTION OF THE PREFERRED EMBODIMENTS

In the following, an element wire and an electric wire including the element wire or the element wires according to a preferred embodiment of the present invention will be explained with reference to FIGS. 1-3 and 4.

Figure 1:
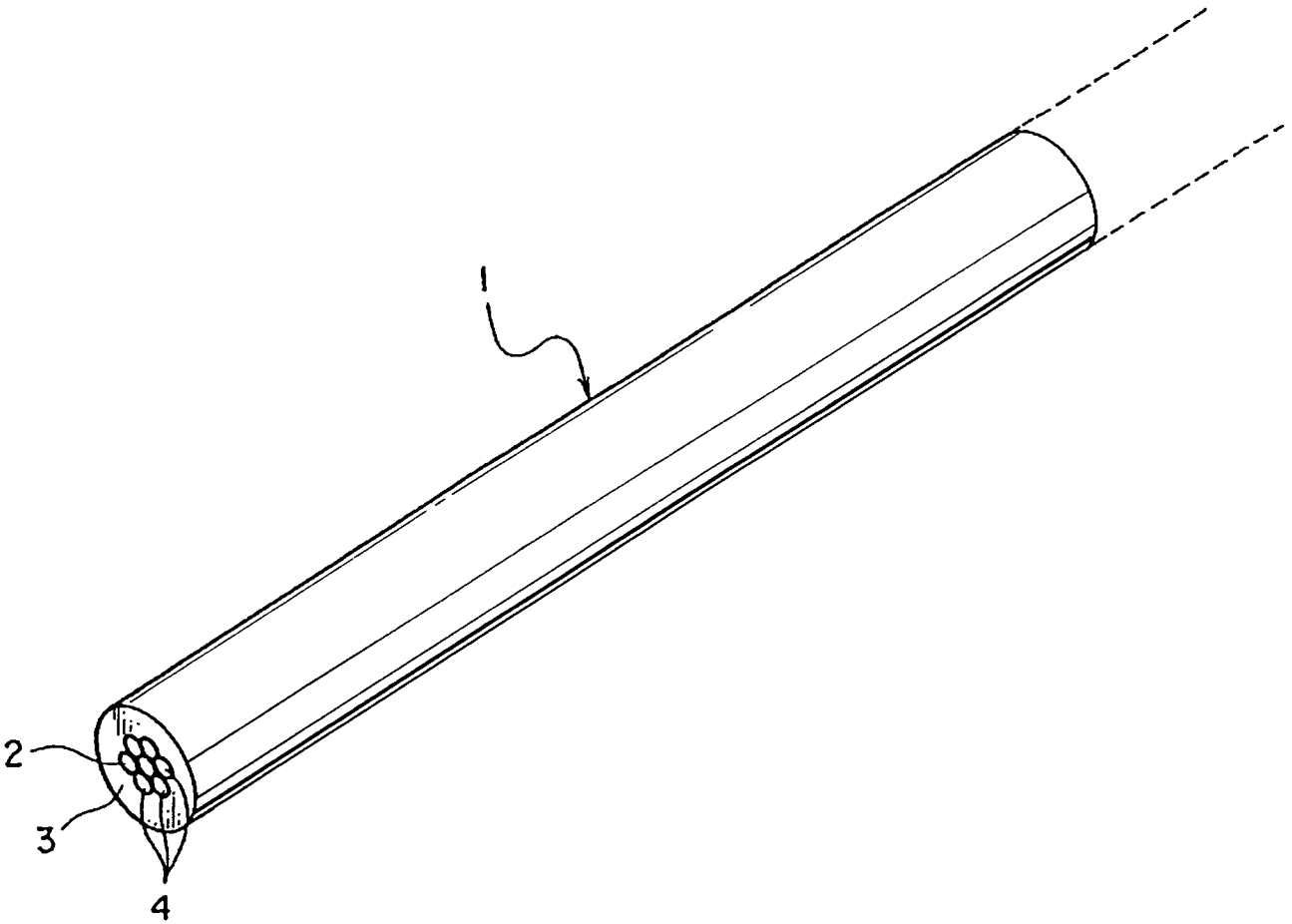
FIG. 1 is a perspective view of an electric wire including element wires according to the preferred embodiment of the present invention.

As shown in FIG. 1, an electric wire 1 according to the preferred embodiment of the present invention is formed in a round shape in section. The electric wire 1 includes an electrically conductive core wire 2 and electrically insulating coating 3. The core wire includes a plurality of element wires 4. The element wire 4 is made of electrically conductive metal such as copper, copper alloy, aluminum or aluminum alloy. The element wire 4 has partly a flat surface extending along an axial direction thereof on an outer surface thereof. The element wire 4 as a whole is formed approximately in a round shape in section. That is, an outer periphery of the section of the element wire 4 consists of a main round part and a partial straight part.

As shown in FIG. 4, the crystal grains, which constitute the entire element wire 4, are fine isometric grains T throughout the entire length in a longitudinal direction of the element wire 4. In this specification, the "isometric grain T" means a crystal grain having an aspect ratio (i.e. width/length) equal to or more than 0.1, while the "elongated grain S" (shown in FIGS. 5A and 5B) means a crystal grain having an aspect ratio (i.e. width/length) less than 0.1. In this specification, that "the crystal grains, which constitute the entire element wire 4, are fine isometric grains T" means that 80% or more of the crystal grains existing within a predetermined area in a section of the element wire 4 are the isometric grains T. Accordingly, for example, even when less than 20% of the crystal grains constituting the entire element wire 4 are the elongated grain S, it is expressed that the crystal grains of the element wire 4 are the isometric grains T. Further, in this specification, the "fine isometric grain T" means the isometric grain having the maximum size equal to or less than 1 μm.

Figure 2:
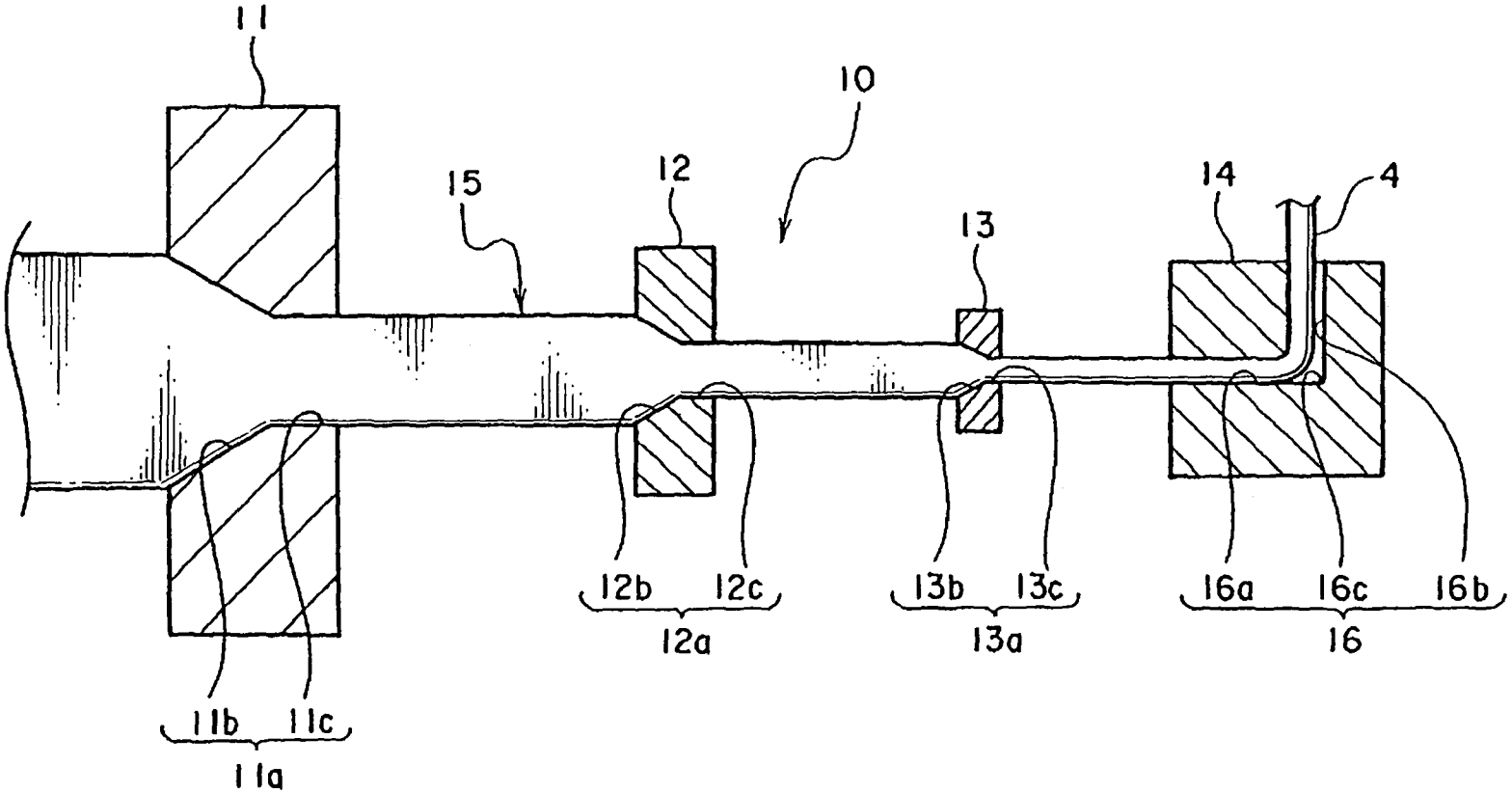
FIG. 2 shows a construction of an apparatus for producing the element wire shown in FIG. 1.
Figure 3:
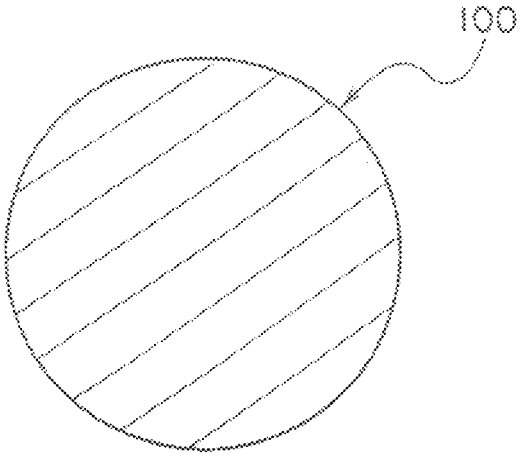
FIG. 3 PRIOR ART
FIG. 3 is a sectional view of a conventional element wire as a comparative example.

The element wire 4 is produced by subjecting an electrically conductive material 15 having a round shape in section to drawing, bending and stretching by using a producing apparatus 10 for producing an element wire shown in FIG. 2. The apparatus 10 includes a plurality of dies 11, 12, 13, a bending-stretching mold 14, and a forwarding device (not shown in the figure).

The dies 11, 12 and 13 made of metal are arranged along a longitudinal direction of the conductive material 15 having a distance therebetween. A central part of each of the dies 11, 12 and 13 is provided with a shaping hole 11*a*, 12*a* and 13*a*, respectively, for reducing an outer diameter of the conductive material 15 by allowing the conductive material 15 to pass therethrough. Each of the shaping holes 11*a*, 12*a* and 13*a* consists of a corresponding large diameter part 11*b*, 12*b* or 13*b*, and a corresponding small diameter part 11*c*, 12*c* or 13*c*, the large diameter part and the corresponding small diameter part being arranged coaxially in series. An inner circumferential surface of each of the large diameter parts 11*b*, 12*b* and 13*b* is formed in a tapered shape so that an inner diameter of each of the large diameter parts 11*b*, 12*b* and 13*b* decreases as approaching the corresponding small diameter part 11*c*, 12*c* or 13*c*. An inner diameter of each of the small diameter parts 11*c*, 12*c* and 13*c* is formed constant in the axial direction.

The aforementioned dies 11, 12 and 13 are hereinafter called the first die 11, second die 12 and third die 13. The maximum inner diameter of the large diameter part 11*b* of the first die 11 is equal to an outer diameter of the conductive material 15 before shaping. An inner diameter of the small diameter part 11*c* of the first die 11 is equal to the maximum inner diameter of the large diameter part 12*b* of the second die 12. An inner diameter of the small diameter part 12*c* of the second die 12 is equal to the maximum inner diameter of the large diameter part 13*b* of the third die 13. An inner diameter of the small diameter part 13*c* of the third die 13 is approximately equal to an outer diameter of the element wire 4. The dies 11, 12 and 13 are arranged at respective positions in such a manner that each of the shaping holes 11*a*, 12*a* and 13*a* has the same axis.

The bending-stretching mold 14 is provided with a through hole 16 bent in a L-shape in the mold 14, through which the conductive material 15 can pass. The through hole 16 is formed in a round shape in section. In an example shown in FIG. 2, the through hole 16 is bent by 90 degrees in the mold 14. That is, the through hole 16 includes two straight parts 16*a* and 16*b* crossing at right angles each other and a bent part 16*c* at which the two straight parts 16*a* and 16*b* cross each other.

The forwarding device described above moves the conductive material 15, which is allowed to pass through the shaping hole 11*a*, 12*a* and 13*a* of the dies 11, 12 and 13 in sequence and further is allowed to pass through the through hole 16 of the bending-stretching mold 14, in a direction leaving the first die 11 along the longitudinal direction of the conductive material 15.

In the producing apparatus 10, the conductive material 15 is allowed to pass through the shaping hole 11*a* of the first die 11, the shaping hole 12*a* of the second die 12 and the shaping hole 13*a* of the third die 13 in sequence by the forwarding device, that is, the conductive material 15 is subjected to drawing plural times (i.e. three times in an example shown in FIG. 2), so that a diameter of the conductive material 15 is reduced stepwise. At this time just after the drawing, the crystal grains of the conductive material 15 are elongated grains.

Thereafter, the apparatus 10 allows the conductive material 15 subjected to the drawing described above to pass through the through hole 16 in the bending-stretching mold 14 so as to move the conductive material 15 in the longitudinal direction thereof. Then, since the through hole 16 is bent in a L-shape, therefore the conductive material 15 is once bent in a L-shape at the bent part 16*c* within the mold 14 and thereafter, the conductive material 15 is extended in a straight shape in the straight part 16*b*, which is located downstream of the bent part 16*c* in the moving direction of the conductive material 15.

Thus, the producing apparatus 10 subjects the conductive material 15 to the bending and extending in sequence within the bending-stretching mold 14. That is, the producing apparatus 10 divides the elongated grains S of the conductive material 15 by bending so as to change the crystal grains, which constitute the entire element wire 4, to the fine isometric grains T. Since the producing apparatus 10 moves the conductive material 15 by means of the forwarding device described above, therefore the producing apparatus 10 subjects the conductive material 15 to the bending and stretching successively in sequence along the longitudinal direction of the conductive material 15. At that time, a part of the conductive material 15 abuts against an inner circumferential surface of the bent part 16*c*. Thus, the element wire 4, in which the crystal grains constituting the entire element wire 4 are the fine isometric grains T, is obtained.

Thereafter, a plurality of the obtained element wires 4 are bundled up and then, an outer periphery of the bundled element wires 4 are coated with an electrically insulating coating 3, so that the electric wire 1 described above is obtained. Then, a terminal fitting or the like is attached to an end of the obtained electric wire 1, so that a wiring harness to be mounted on a motor vehicle and so on is constructed.

According to the preferred embodiment described above, since the crystal grains constituting the entire element wire 4 are the fine isometric grains T, therefore the ductility of the element wire 4 is improved. As a result, the element wire 4 is hardly broken when the wiring harness composed of the electric wires 1 including the element wires 4 is being mounted on a motor vehicle. That is, handling of the wiring harness does not require particular caution to a worker.

Further, since such an element wire 4 is excellent in terms of ductility and mechanical strength, therefore the element wire 4 is hardly broken when the electric wire 1 is being produced and when the wiring harness is being assembled by combining the electric wires 1 as well as when the wiring harness is being mounted on a motor vehicle.

Since the conductive material 15 is subjected to the drawing so as to reduce the diameter of the conductive material 15 and subsequently subjected to successive bending and stretching in sequence along the longitudinal direction of the conductive material 15, therefore the elongated grains S of the electrically conductive material 15 are divided into parts thereof and therefore, the crystal grains constituting the entire element wire 4 become fine isometric grains T. Accordingly, the ductility of the element wire 4 of the electric wire 1 can be securely improved. Since the drawing is performed plural times, therefore the element wire 4 can be made thin, that is, the electric wire 1 can be made thin.

Further, since the electrically conductive material 15 subjected to the drawing is allowed to pass through the bent through hole 16 of the bending-stretching mold 14, therefore the conductive material 15 subjected to the drawing can be securely subjected to the bending and stretching successively along the longitudinal direction of the conductive material 15. As a result, the crystal grains constituting the whole of the element wire 4 securely become fine isometric grains T. Accordingly, the ductility of the element wire 4 can be securely improved.

The effects of the present invention were confirmed, in which a comparison was performed between a conventional element wire 100 (hereinafter, Comparative Example; shown in FIG. 3) obtained by drawing only and an element wire 4 according to the preferred embodiment of the present invention (hereinafter, Example) obtained by drawing and subsequent bending and stretching in sequence.

Figure 5A:
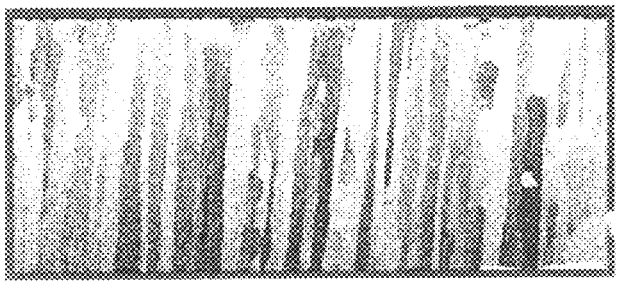
FIG. 5A PRIOR ART
FIG. 5A is an enlarged image of a section of the conventional element wire as the comparative example shown in FIG. 3.
Figure 5B:
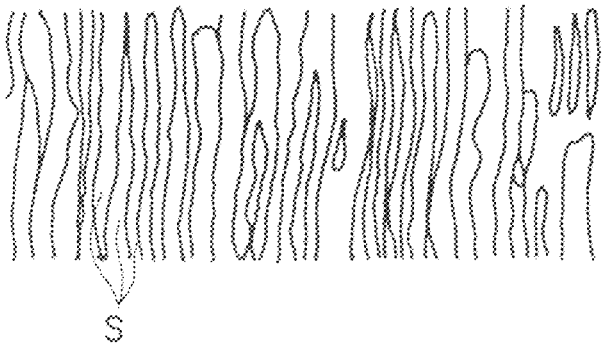
FIG. 5B PRIOR ART
FIG. 5B is a schematic illustration of the section of the conventional element wire as the comparative example shown in FIG. 3.

As for the Comparative Example, an electrically conductive material made of copper alloy having an outer diameter of 2.6 mm was subjected to repeated drawing until the outer diameter became 0.21 mm. That is, an outer diameter of the element wire 100 obtained was 0.21 mm. FIG. 5A is an enlarged image of a section of the element wire 100 obtained as the Comparative Example. FIG. 5B is a schematic illustration of the section of the element wire 100. As shown in FIGS. 5A and 5B, most (i.e. equal to or more than 80%) of the crystal grains of the Comparative Example were elongated grains S.

Figure 4A:
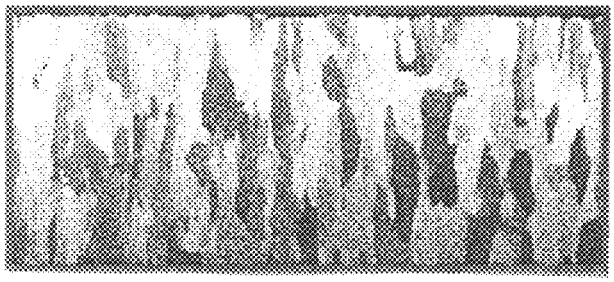
FIG. 4A is an enlarged image of a section of an element wire according to the preferred embodiment of the present invention.
Figure 4B:
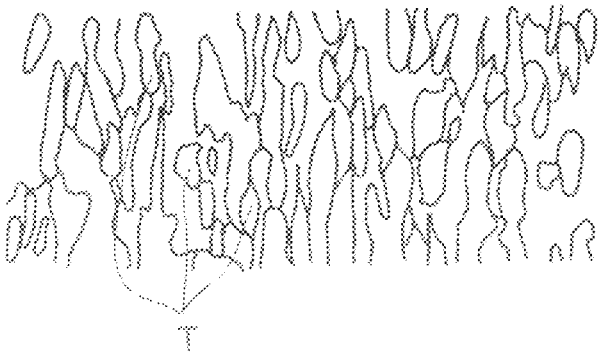
FIG. 4B is a schematic illustration of the section of the element wire according to the preferred embodiment of the present invention.

As for the Example, an electrically conductive material 15 made of copper alloy having an outer diameter of 2.6 mm was subjected to repeated drawing until the outer diameter became 0.20 mm. Subsequently, thus obtained conductive material 15 was allowed to pass through the bent through hole 16 of the bending-stretching mold 14 so as to be subjected to bending and stretching in sequence in the longitudinal direction of the conductive material 15 throughout the whole length of the conductive material 15. That is, an outer diameter of the element wire 15 obtained was 0.20 mm. FIG. 4A is an enlarged image of a section of the element wire 15 obtained as the Example. FIG. 4B is a schematic illustration of the section of the element wire 15. As shown in FIGS. 4A and 4B, most (i.e. equal to or more than 80%) of the crystal grains of the Example were fine isometric grains T.

Tensile tests were performed with respect to both of the Comparative Example and the Example, in which a breaking extension (mm) of each element wire measured from a start of the test until breaking of the element wire and a stress upon the breaking (i.e. maximum stress) were measured. The results are shown in Table 1.

TABLE 1

| | Maximum Stress [MPa] | Breaking Extension [mm] |
|---|---|---|
| Comparative Example | 483 | 1.08 |
| Example | 527 | 2.56 |

Table 1 reveals that the breaking extension of the Example is 237% of that of the Comparative Example and the stress upon the breaking (i.e. maximum stress) of the Example is 109% of that of the Comparative Example. That is, it is revealed that the ductility of the element wire 4 is improved and the mechanical strength of the element wire 4 is also improved by making the crystal grains constituting the entire element wire 4 be the fine isometric grains T with a process, in which the electrically conductive material 15 is subjected to drawing and subsequently to bending and stretching in sequence.

In the present invention, the metal which constitutes the element wire 4 may consist of a single element such as copper or aluminum or, alternatively, an alloy including a plurality of elements such as copper alloy or aluminum alloy provided that the metal is not amorphous. The core wire 2 may consist of one element wire 4 or a plurality of element wires 4 twisted together or bundled up together. The through hole 16 may not be limited to 90 degrees and may be bent by various angles. In the preferred embodiment described above, the conductive material 15, which is subjected to the drawing, is subsequently subjected to the bending and the stretching in sequence. However, in the present invention, the conductive material 15, which is subjected to the drawing, may be subsequently subjected to at least the bending.

That is, the conductive material 15, which is subjected to the drawing, may not necessarily be subsequently subjected to the stretching.

In the preferred embodiment described above, the outer periphery of the section of the element wire 4 consists of a main round part and a partial straight part. However, in the present invention, the element wire 4 may be formed round in section by allowing the element wire 4 including the partial straight part in section to pass through the round dies so as to form the element wire 4 provided that the crystal grains of the element wire 4 are maintained isometric. In the example shown in FIG. 2, the conductive material 15 is subjected to the drawing three times. However, in the present invention, the drawing of the conductive material 15 may be repeated any number of times in order to reduce the outer diameter of the conductive material 15 to a desired value.

The aforementioned preferred embodiments are described to aid in understanding the present invention and variations may be made by one skilled in the art without departing from the spirit and scope of the present invention.

What is claimed is:

1. An element wire made of an electrically conductive material, comprising:

a flat surface extending along an axial direction thereof on an outer surface thereof, and a main round part and a partial straight part on an outer periphery of a cross section thereof;

wherein the element wire comprises 80% of fine isometric grains and 20% of elongated grains formed along a longitudinal direction of the element wire;

wherein the fine isometric grains are defined such that 80% or more of the crystal grains existing within a predetermined area in a section of the element wire have the maximum size equal to or less than 1 μm, wherein each of the fine isometric grains has an aspect ratio of width/length equal to or more than 0.1; and wherein the elongated grains comprise crystal grains having an aspect ratio of width/length of less than 0.1.

2. An electric wire comprising;

a core wire including at least one said element wire according to claim 1; and a coating which coats the core wire.

3. The element wire according to claim 1, wherein the electrically conductive material is metal.

4. The element wire according to claim 3, wherein the metal is selected from the group consisting of copper, aluminum, copper alloy and aluminum alloy.

* * * * *